US007244140B2

(12) United States Patent
Edenharter

(10) Patent No.: US 7,244,140 B2
(45) Date of Patent: Jul. 17, 2007

(54) SPRING-OPERATED PLUG TERMINAL

(75) Inventor: Georg Edenharter, Rieden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/525,039

(22) Filed: Sep. 22, 2006

(65) Prior Publication Data

US 2007/0072481 A1 Mar. 29, 2007

(30) Foreign Application Priority Data

Sep. 23, 2005 (DE) ..... 10 2005 045 596

(51) Int. Cl.
*H01R 4/24* (2006.01)

(52) U.S. Cl. ..... 439/441; 439/439; 439/861

(58) Field of Classification Search ..... 439/441, 439/439, 218, 787, 861, 860
See application file for complete search history.

(56) References Cited

U.S. PATENT DOCUMENTS

| | | | | |
|---|---|---|---|---|
| 6,814,608 | B2 * | 11/2004 | Kollmann | 439/441 |
| 6,893,286 | B2 * | 5/2005 | Drewes et al. | 439/441 |
| 6,911,602 | B2 * | 6/2005 | Conrad | 174/68.2 |
| 7,004,781 | B2 * | 2/2006 | Walter | 439/441 |
| 7,083,463 | B2 * | 8/2006 | Steinkemper et al. | 439/441 |

FOREIGN PATENT DOCUMENTS

| | | | |
|---|---|---|---|
| DE | 1 261 923 | B | 2/1968 |
| DE | 81 36 054 | U1 | 4/1982 |
| DE | 32 33 457 | C2 | 1/1986 |
| DE | 202 06 763 | U1 | 10/2002 |
| DE | 202 10 105 | U1 | 11/2002 |
| DE | 203 13 041 | U1 | 11/2003 |
| DE | 203 12 861 | U1 | 12/2003 |
| EP | 0 908 965 | A1 | 4/1999 |
| EP | 1 081 790 | B1 | 3/2003 |

* cited by examiner

*Primary Examiner*—Phuong Dinh
(74) *Attorney, Agent, or Firm*—Harness, Dickey & Pierce, P.L.C.

(57) ABSTRACT

A spring-operated plug terminal is disclosed. The spring-operated plug terminal includes a U- or Ω-shaped spring, which has two separate spring arms and thus two spring ends, and a rectangular terminal frame, which has a square cutout and a clamping piece which is angled away from the plane of the terminal frame. One fixed end of the spring is arranged in a fixed position in the cutout and the two ends of the spring arms, together with the clamping piece of the terminal frame, form a clamping zone for two conductor cores and/or flat plug to be connected. Each spring end includes a central, straight first section, in the form of a clamping edge, for making inter-engaging contact with a conductor core. Further, each spring end includes an edge-side, curved second section which forms a clamping surface. The clamping surface protrudes beyond the clamping edge in the direction of termination, so that contact can be made with a flat plug simply by applying pressure.

16 Claims, 3 Drawing Sheets

SPRING-OPERATED PLUG TERMINAL

PRIORITY STATEMENT

The present application hereby claims priority under 35 U.S.C. §119 on German patent application number DE 10 2005 045 596.4 filed Sep. 23, 2005, the entire contents of which is hereby incorporated herein by reference.

FIELD

The invention relates in general to spring-operated plug terminals.

BACKGROUND

Spring-operated plug terminals are known from DE 202 10 105 U1, DE 202 06 763 U1, DE 203 13 041 U1, EP 0 908 965 A1, DE 81 36 054 U1, DE 203 12 861 U1, as well as from DE 12 61 923 B.

Spring-operated plug terminals typically find application in switching devices, circuit breakers and also in terminal strips, for example. Single conductors with various cross-sections and profiles, with or without attachments such as cable shoes or multi-core cable-end sleeves, can be connected in such a spring-operated plug terminal.

The spring-operated plug terminals known from DE 202 10 105 U1 have a U-shaped spring, which has two separate spring arms and thus two spring ends, and a terminal frame which has square cutouts and a clamping piece which is angled away from the plane of the terminal frame. One fixed end of the spring is arranged in a fixed position in the cutout, and the two spring ends of the spring arms, together with clamping pieces of the terminal frame, form a clamping zone for making interengaging contact with two conductor cores to be connected. The ends of the springs form continuous clamping edges.

Similar spring-operated plug terminals are known from DE 202 06 763 U1.

The spring-operated plug terminals known from DE 12 61 923 B are provided with a V-shaped plug terminal spring element. The spring-operated plug terminals are also provided with a first arm in the form of a base plate, and a second arm divided in the middle of the longitudinal direction of the arm as standard. Both parts of the second arm are provided on their ends firstly with cutting edges for clamping a conductor and secondly with an offset web, which serves to apply pressure using a tool or else an operating device, and therefore to release a clamped conductor.

However, spring-operated plug terminals with conventional clamping characteristics are desirable for reliable connection of electrical conductors, which, in addition, can be used on the one hand for checking and testing purposes, and on the other are particularly suitable for easy multi-pole contact-connection or disconnection.

SUMMARY

At least one embodiment of the invention includes providing a spring-operated plug terminal which is multi-functional and therefore can be used for various clamping applications.

According to at least one embodiment of the invention, a spring-operated plug terminal is disclosed.

In at least one embodiment, in addition to the first part of the spring end, used for captive contact of a conductor in the spring-operated plug terminal, designed as part of the spring-operated plug terminal with a clamping edge, in which the conductor can only be released using an operating device, as a result of the design of the second part of the spring end with a clamping surface, it is possible to make contact with the conductor to be connected under pressure, but not locked, interengaged or clamped, so that the conductor can be released when required from the spring-operated plug terminal without release or operating device, that is to say by simply pulling on the conductor. As a result, a spring-operated plug terminal is consequently provided which makes possible both a safe and a simply releasable clamping connection with the conductor or conductors.

In at least one embodiment, contrary to the spring-operated plug terminals already known from the cited documents, there is, for example, for a conductor to be temporarily connected, no requirement for a tool or operating device to release the clamped conductor. This characteristic of the spring-operated plug terminal can be used particularly for connecting and disconnecting multi-pole switching devices or circuit breakers in a simple manner in combination with a further device, and in addition enables, for example for checking purposes, for voltage measurement or similar, not only simple conductor clamping but also simple conductor release. This also avoids the need for further clamping points for connection of devices which would otherwise also have to be provided in addition to the anti-tug clamp points, since with the spring-operated plug terminals according to at least one embodiment of the invention, both functions are fulfilled in a space-saving manner.

In at least one embodiment, the spring end is advantageously fitted with a third part, which provides a clamping surface for making pressure contact with a conductor. The third spring end part is, like the first spring end part, arranged in the region of the external longitudinal edge of the spring end, so that the second spring end part is located between the first and third spring end parts. A conductor to be connected for test purposes, for example, is provided, in particular, with a flat shape, that is to say with rectangular cross section, and with a conductor width of approximately the distance between the first and third spring end parts, and is thus able to provide a conductive connection to these. The second spring end part, or central part, is set back in comparison to the two opposite spring end parts, and is therefore particularly suitable for making a permanent, fixed connection for a round conductor introduced between the two external spring end parts.

In at least one embodiment, the spring end advantageously has a fourth part as an operating extension for an operating device, for example a screwdriver, an eccentric lever or a pushbutton, so that a conductor can be released in a convenient manner in compliance with contact-protection regulations.

In one advantageous design of at least one embodiment, the first part of the spring end and at least one of the other parts of the spring end have a common base body, whereby separate spring linkage components can be avoided and a compact design can be achieved.

The base body is advantageously in the form of a terminal frame, so that a spring linkage and an opposing pressure or contact piece is created using only one component.

The spring is advantageously fixed to one side of the terminal frame and on the other side, which is opposite the first side, of the terminal frame the spring end parts of the spring are arranged such that they can move in the region of a contact piece, with the contact piece being part of the terminal frame; thus the terminal frame offers all of the components needed for clamping a conductor in a very compact design.

In one advantageous development, the contact piece is at right angles to the longitudinal direction of the terminal frame in order to form a supporting surface for the conductor, whereby a conductor guide is provided, which also eliminates any tendency for the conductor to bend.

The terminal frame advantageously has a double spring, which provides a first and second spring which each have separate spring ends; as a result, it is possible to connect, for example, a round conductor using one clamp spring, and to be connected in an interlocking manner to connect a pressure-contacted flat test plug or else a flat device plug using the other clamping spring.

BRIEF DESCRIPTION OF THE DRAWINGS

The invention and advantageous refinements according to the features of the embodiments are explained in more detail below with the aid of example embodiments which are illustrated in the drawings, without restriction to the invention; in the drawings.

DETAILED DESCRIPTION OF THE EXAMPLE EMBODIMENTS

Figure 1:
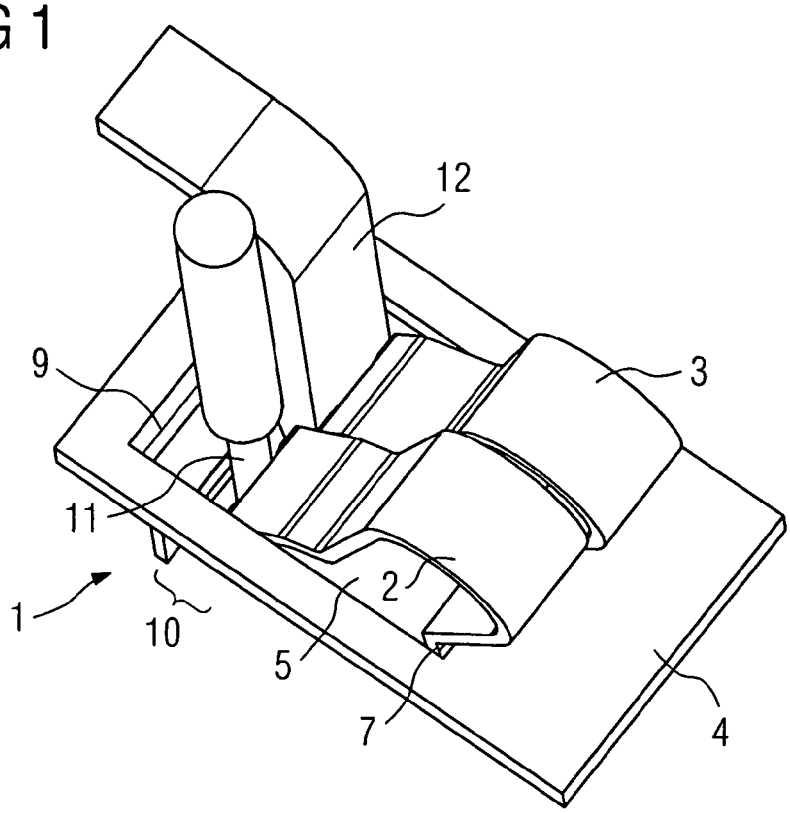
FIGS. 1 and 2 show a spring-operated plug terminal according to an embodiment, shown from various perspectives with a clamped round conductor and a clamped flat conductor.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described.

Figure 2:
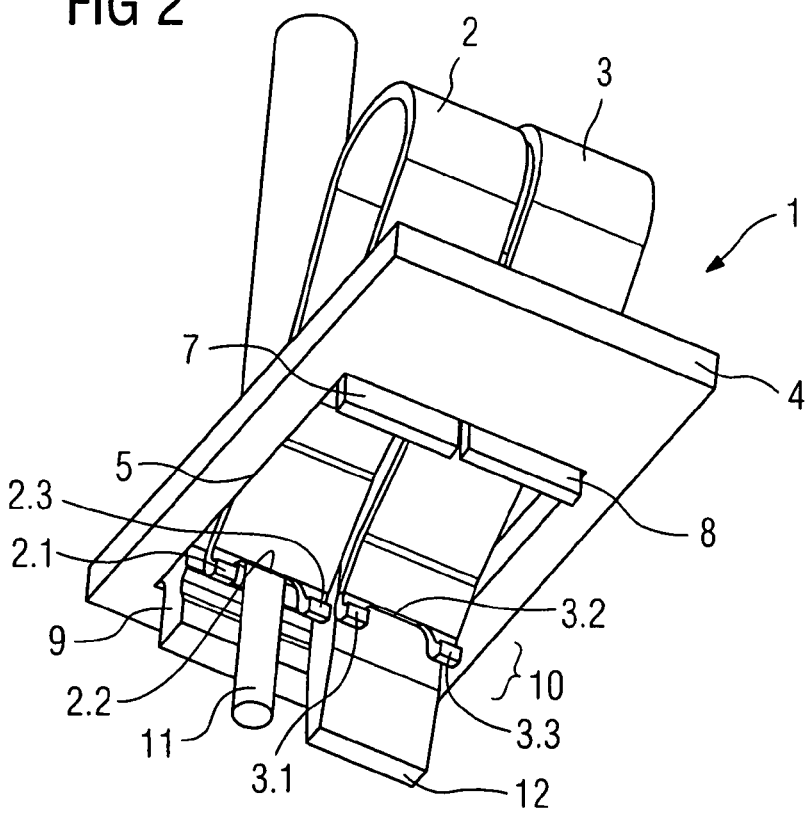
Figure 3:
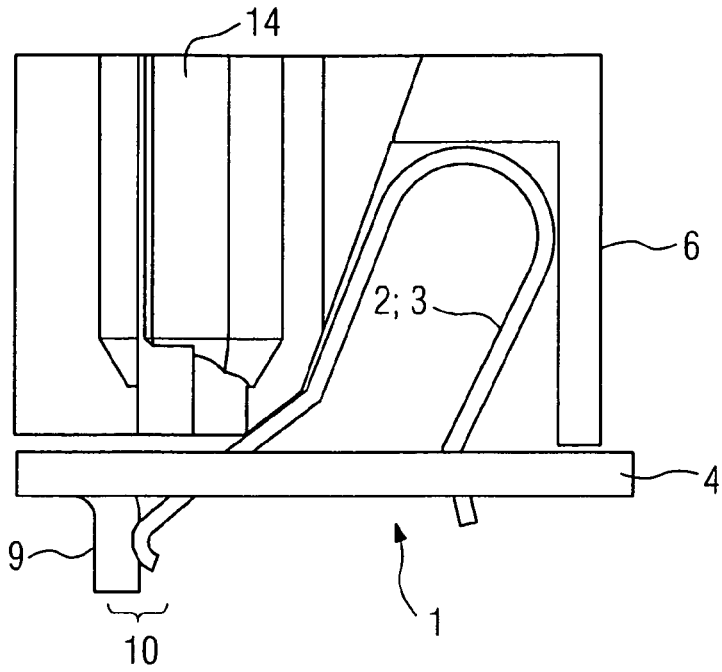
FIG. 3 shows a side view of the spring-operated plug terminal from FIG. 1, enclosed in a casing part with no attached conductor.

A spring-operated plug terminal 1 is shown in FIGS. 1 and 2, which has a first spring element and a second, separate spring element 2; 3. Both of the spring elements 2; 3 have an approximately U or Ω shape and are fixed at one end in a rectangular base body which acts as a terminal frame 4 and which has a square cutout 5 and is fixed in position by casing part 6 as shown in FIG. 3. However, the fixed ends of the spring elements 7, 8 can also be inserted in a slotted cutout in the terminal frame 4, where they are fixed by soldering, welding or bonding. Opposite the fixing point of the spring elements 2, 3, the terminal frame provides a clamping piece 9 in the form of a bracket, which serves as a conductor support and therefore as a mating pressure piece for making contact with the conductor. The terminal frame 4 is generally a steel plate, whereas the spring elements 2, 3 are made from spring steel.

At the free end, that is to say in the area of the clamping piece 9, and, therefore, in the clamping zone 10 of the spring-operated plug terminal 1, both spring elements 2, 3 are subdivided into several parts 2.1, 2.2, 2.3; 3.1, 3.2, 3.3. In an extension to their two longitudinal edges, the respective ends of the two spring elements 2, 3 are each provided with curved projections 2.1, 2.3; 3.1, 3.3 having sliding surfaces. The two projections 2.1, 2.3; 3.1, 3.3 are designed such that their convex sides, or external radius, are/is facing the contact piece 9. Between the two projections 2.1, 2.3; 3.1, 3.3, the respective spring end has a central part 2.2; 3.2, which is set back from the external projections 2.1, 2.3; 3.1, 3.3 in the longitudinal axis of the free spring arm.

In contrast to the projections 2.1, 2.3; 3.1, 3.3, the central part 2.2; 3.2 has a prominent notched edge and can be modified by cutting or punching processes. In one advantageous development, the spring end may have a fourth part, offset from the other parts, in the form of an operating projection for an operating means, for example a screwdriver. Due to tension or compression of the fourth part by the operating means, the contact zones, particularly those of the central part 2.2; 3.2, can be enlarged for ease of release of at least one connected conductor. The various parts 2.1 to 2.3 and 3.1 to 3.3 of the spring end can therefore be separated, raised or offset in relation to one another, in order to make contact with various conductors, particularly of different shapes and cross sections.

In the case of the first spring element 2, the conductor core 11 of the illustrated round conductor is inserted and interengages between the clamping piece 9 and the spring end for making contact with the clamping edge of the central part 2.2; in this case the conductor core 11 has a diameter smaller than the clearance between the two spaced-apart spring end parts 2.1, 2.3. In the adjacent case, a flat conductor 12 is inserted between the clamping piece 9 and the end of the spring, the flat conductor having a width approximately corresponding to the distance between the two projections 3.1, 3.3, so that the flat conductor 12 makes an electrically conductive connection with the terminal frame 4 via the two rounded contact surfaces of the spring end. In both cases, the terminal frame 4 can be connected to device components using connections such as conductive cables.

FIG. 3 shows a section through the spring-operated plug terminal 1, with the spring elements 2, 3 being located in the casing part 6 and held in position by the casing element. The force and angle of movement of the spring arms 2, 3 is so great that the respective mobile end of the spring comes to rest against the contact piece 9 if no conductor has been inserted. Above this, that is to say in the direction of the bend 13 in the spring 2, 3, a conductor entry opening 14 in the casing part 6 runs almost parallel with the longer of the two arms and terminates in the clamping zone 10.

Figure 4:
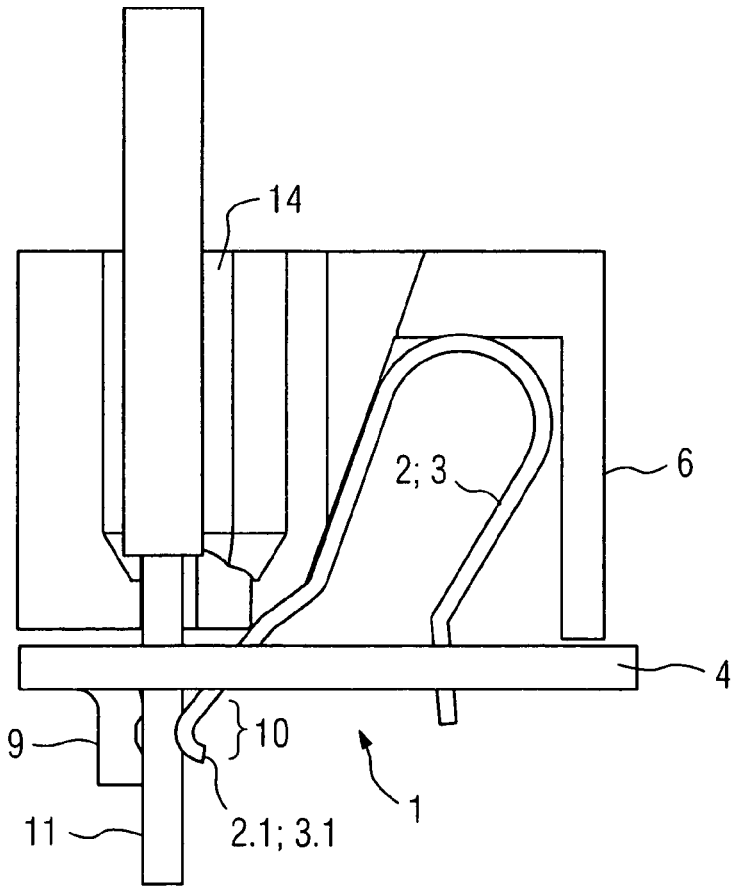
FIG. 4 shows a side view of the spring-operated plug terminal from FIG. 2, with a clamped round conductor.

FIG. 4 shows the arrangement of components according to FIG. 3, but with a round conductor inserted, whose conductor core 11 is securely fixed against any tension in the direction of conductor entry opening 14 through the clamping edge 15 of the spring element 2, 3. The setting angle of the long arm of the spring 2, 3 of approximately 30° to 60° in relation to the clamped conductor core 11 has a favorable effect on any retarding action. It can be seen clearly that the projections 2.1, 2.3; 3.1, 3.3, together with the spring ends, are pivoted past the conductor core 11 until the closing contact edge 15 comes to rest against the conductor core 11.

Figure 5:
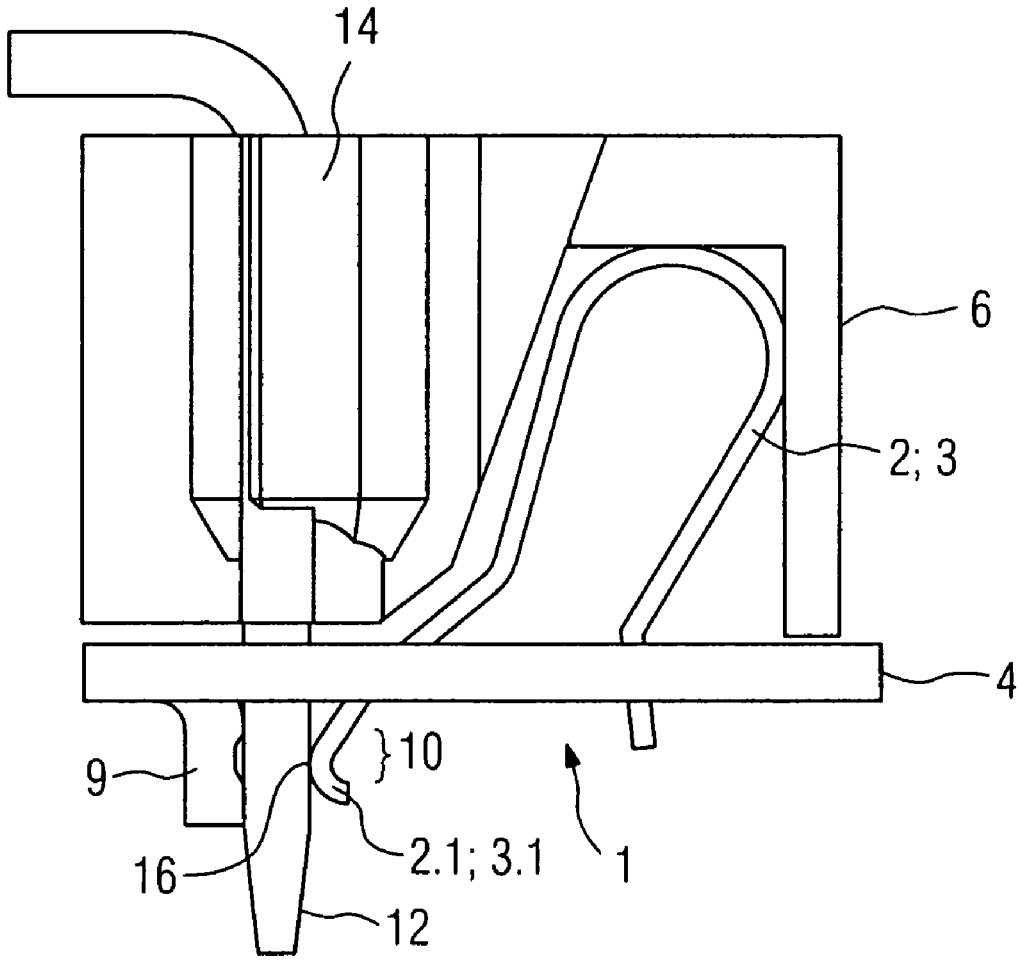
FIG. 5 shows a side view of the spring-operated plug terminal from FIG. 2 with a clamped flat conductor.

FIG. 5 shows the arrangement of components according to FIG. 3, with a flat conductor or flat plug 12. In this configuration, the flat plug 12 can be pushed through beneath the projections 2.1, 2.3; 3.1, 3.3 provided with radii, until the required contact position on the contact surface 16 is reached. Because of the geometry of the contact end of the spring 2; 3, no undesirable retarding action can occur against the flat plug 12, so that the plug can be easily removed again in the direction opposite to its plug-in direction. The contact pressure can, of course, be determined by the choice of spring material and spring dimensions.

For multi-pole devices, particularly for switch gear such as contactors, circuit breakers or overload relays, which, for example, are fitted with three knife contacts per connection side, each of which is to be connected to a contact holder of an extension device to be coupled to the device, an electrical connection can be created between the devices by simple insertion of the contacts into the contact holders. Afterward the devices can be rendered mechanically safe by, for example, stacking them in a suitable manner on top-hat rails. In order to electrically separate the interconnected devices, it is only necessary to pull them apart without having to employ the operating or release means controlling the spring contacts, which would have to be operated simultaneously and with difficulty, in order to achieve the required disassembly. Of course, single conductors, which as a rule are used on the output side in single devices or groups of devices, can also be connected. It should be noted in this case that round conductors can only be released with the aid of a tool, whereas a flat conductor or plug can be withdrawn without a tool.

At least one embodiment of the invention as described above can be summarized as follows:

In order to provide a spring-operated plug terminal 2, 3, which is multi-functional and can therefore be used for various clamping applications, it is provided that, in addition to a part 2.2; 3.2 of the divided spring end of the clamping spring 2, 3, which has a clamping edge 15 for inter-engaging contact of a rigid conductor 11 or conductor 11 with attachments, the further part 2.1, 2.3 of the spring end 2, 3 is designed with a clamping surface 16 for the other part 2.1; 2.3 of the spring end 2, 3 for making sliding contact with a further conductor 12.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spring-operated plug terminal, comprising:

at least one of a U-shaped and Ω-shaped spring, the spring including two separate spring arms with two separate spring ends; and a rectangular terminal frame, the frame including a square cutout and a clamping piece angled away from the plane of the terminal frame, wherein one fixed end of the spring is arranged in a fixed position in the cutout and wherein the two ends of the spring arms, together with the clamping piece of the terminal frame, form a clamping zone for connecting at least one of two conductor cores and a flat plug, each spring end including a central, straight first section in the form of a clamping edge, for making inter-engaging contact with a conductor core, and including an edge-side, curved second section forming a clamping surface which protrudes beyond the clamping edge in the direction of termination, to permit simple contact with a flat plug by pressure application.

2. The spring-operated plug terminal as claimed in claim 1, wherein the spring is fixed on one side of the terminal frame and on the other side, opposite the first side of the terminal frame, the spring end parts of the spring are arranged to be movable in the region of a contact piece.

3. The spring-operated plug terminal as claimed in claim 2, wherein the contact piece is part of the terminal frame.

4. The spring-operated plug terminal as claimed in claim 2, wherein the contact piece is at right angles to the longitudinal direction of the terminal frame to form a supporting surface for the conductor.

5. The spring-operated plug terminal as claimed in claim 1, wherein the terminal frame is equipped with a double spring including two springs with separate spring ends.

6. A casing comprising at least one spring-operated plug terminal as claimed in claim 1.

7. The spring-operated plug terminal as claimed in claim 3, wherein the contact piece is at right angles to the longitudinal direction of the terminal frame to form a supporting surface for the conductor.

8. The spring-operated plug terminal as claimed in claim 2, wherein the terminal frame is equipped with a double spring including two springs with separate spring ends.

9. The spring-operated plug terminal as claimed in claim 3, wherein the terminal frame is equipped with a double spring including two springs with separate spring ends.

10. The spring-operated plug terminal as claimed in claim 4, wherein the terminal frame is equipped with a double spring including two springs with separate spring ends.

11. The spring-operated plug terminal as claimed in claim 7, wherein the terminal frame is equipped with a double spring including two springs with separate spring ends.

12. A casing comprising at least one spring-operated plug terminal as claimed in claim 2.

13. A casing comprising at least one spring-operated plug terminal as claimed in claim 3.

14. A casing comprising at least one spring-operated plug terminal as claimed in claim 4.

15. A casing comprising at least one spring-operated plug terminal as claimed in claim 5.

16. A casing comprising at least one spring-operated plug terminal as claimed in claim 7.

* * * * *